US008683921B2

(12) United States Patent
Poeling et al.

(10) Patent No.: US 8,683,921 B2
(45) Date of Patent: Apr. 1, 2014

(54) MODULAR DECORATING MACHINE FOR CONICAL PRODUCTS

(75) Inventors: David L. Poeling, St. Charles, MO (US); Jeffrey E. Debus, Ballwin, MO (US)

(73) Assignee: The Beckwood Corporation, Inc., Fenton, MO (US)

( * ) Notice: Subject to any disclaimer, the term of this patent is extended or adjusted under 35 U.S.C. 154(b) by 283 days.

(21) Appl. No.: 13/215,994

(22) Filed: Aug. 23, 2011

(65) Prior Publication Data

US 2013/0047871 A1 Feb. 28, 2013

(51) Int. Cl.
*B41F 17/08* (2006.01)
*B41D 7/00* (2006.01)
*B41F 21/00* (2006.01)

(52) U.S. Cl.
USPC ..... 101/38.1; 101/33; 101/407.1; 101/475

(58) Field of Classification Search
USPC ..... 101/38.1, 33–35, 126, 407.1, 475
See application file for complete search history.

(56) References Cited

U.S. PATENT DOCUMENTS 2,920,556 A * 1/1960 Medert et al. ..... 101/38.1
4,175,993 A 11/1979 Robertson ..... 156/234
4,263,846 A 4/1981 Eldred et al. ..... 101/40
4,336,095 A * 6/1982 Hoffmann ..... 156/361
4,379,818 A 4/1983 Lock et al. ..... 430/5
4,440,589 A 4/1984 Lock ..... 156/232
4,508,031 A 4/1985 Rajnik ..... 101/41
5,123,345 A 6/1992 Wood ..... 101/124
6,045,744 A 4/2000 Kobayashi et al. ..... 264/511
6,070,524 A 6/2000 Marroquin-Garza et al. 101/129
6,073,553 A 6/2000 Tweedy et al. ..... 101/40
6,223,653 B1 * 5/2001 Christ ..... 101/38.1
6,369,843 B1 4/2002 Springett et al. ..... 347/173
6,490,969 B2 12/2002 Aichele ..... 101/37
6,998,006 B1 2/2006 Kessler et al. ..... 156/230
7,819,055 B2 * 10/2010 Tezuka et al. ..... 101/38.1
8,322,279 B2 * 12/2012 Demange et al. ..... 101/38.1

OTHER PUBLICATIONS

Product Brochure for CPS VRO 4T and CPS PVT 200; dated prior to Aug. 23, 2011(1 page).

* cited by examiner

*Primary Examiner* — Ren Yan
(74) *Attorney, Agent, or Firm* — Nixon Peabody LLP

(57) ABSTRACT

A decorating machine applies artwork to a product having a central axis and a frustoconical surface around its central axis. The decorating machine includes a film with artwork, a moveable deck, and a roller. The moveable deck includes a rotating mount on which the product is rotatably mounted. The product undergoes a pendulum-like movement on the deck while the product rotates relative to the moveable deck. The roller has a frustoconical shape that generally corresponds to the frustoconical surface of the product. The film is located between the roller and the product. The roller provides heat and pressure to the film such that the artwork attaches to the frustoconical surface of the product.

9 Claims, 4 Drawing Sheets

| Inputs | | |
|---|---|---|
| Major Diameter | = | A |
| Minor Diameter | = | B |
| Length | = | C |
| Rotating Member Height | = | D |
| Horizontal Speed (x-Direction) | = | E |

MODULAR DECORATING MACHINE FOR CONICAL PRODUCTS

TECHNICAL FIELD

The present invention relates generally to decorating machines and, in particular, to a modular decorating machine that allows for artwork to be attached to a variety of frustoconically shaped products by a pendulum-type of movement of the product relative to the artwork.

BACKGROUND

Decorating machines permit decorative artwork to be placed on the surfaces of various products. Known types of decorating machines use a rolling heat-transfer device, such as silicone rubber roller, to provide heat and pressure directly to a film containing the decorative artwork. The artwork from the film, which is engaged against the product, is removed from the film and attached to the product.

One problem with known decorating machines is due to the fact that they can only be used for a flat surface that has very little or no contouring or for a cylindrical surface (sometimes referred to as peripheral decorating). In other words, known decorating machines are limited to applying artwork to products with simple geometries. For products having a frustoconical shape, like cups or mugs, decorating machines have been designed to apply artwork to the specific geometry of the frustoconical surface of that product (i.e. they lack modularity to provide artwork to variety of frustoconical surfaces). For these types of more complex surfaces, like frustoconical surfaces, it is often more typical to use screen-printing or pad printing. However, compared to decorating machines, each of these types of printing is more complex and costly, and involves the use of inks and solvents that must be properly dried.

Thus, it would be desirable to have a single decorating machine that could be used to apply artwork to an array of products having a variety of frustoconical surfaces. The present invention satisfies this long-felt need.

SUMMARY

According to one embodiment, a decorating machine applies artwork to a product having a central axis and a frustoconical surface around its central axis. The decorating comprises a film that includes the artwork and that extends in a first direction. The decorating machine further includes a deck, a track structure, and a roller. The deck has a rotating mount on which the product is mounted and the deck is pivotable to adjust the pitch angle of the deck. A track structure includes a track extending in the first direction and the deck moves along the track in the first direction. The track structure is also movable in a second direction generally perpendicular to the first direction. The roller forces the artwork against the frustoconical surface of the product. The roller provides heat and pressure to the film such that the artwork becomes attached to the frustoconical surface of the product. The combination of (i) the pivotable movement of the deck, (ii) the movement of the track structure in the second direction, and (iii) the movement of the deck along the track in the first direction, causes the product to undergo a pendulum-like movement while the product is rotating around its central axis and receiving the applied artwork.

According to another embodiment, a decorating machine applies artwork to a product having a central axis and a frustoconical surface around its central axis. The decorating machine includes a user interface for inputting dimensions of the product, a film with artwork, a moveable deck, and a roller. The moveable deck includes a rotating mount on which the product is rotatably mounted. The product undergoes a pendulum-like movement on the deck based on the inputted dimensions while the product rotates relative to the moveable deck. The roller has a frustoconical shape that generally corresponds to the frustoconical surface of the product. The film is located between the roller and the product. The roller provides heat and pressure to the film such that the artwork attaches to the frustoconical surface of the product.

According to yet another embodiment, the present invention involves a method of using a machine to apply artwork to a selected one of a plurality of products that have different frustoconical surfaces. The method includes inputting, via an input device on the machine, information related to dimensions of the selected product. While artwork remains substantially stationary, the method involves moving the product along a curved path such that the product contacts the artwork. The curved path is determined by the inputted information for the selected product. The method involves rotating the product while the product is moving along the curved path, and applying heat and pressure to the artwork as the product rotates so as to cause the artwork to be attached to the product The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
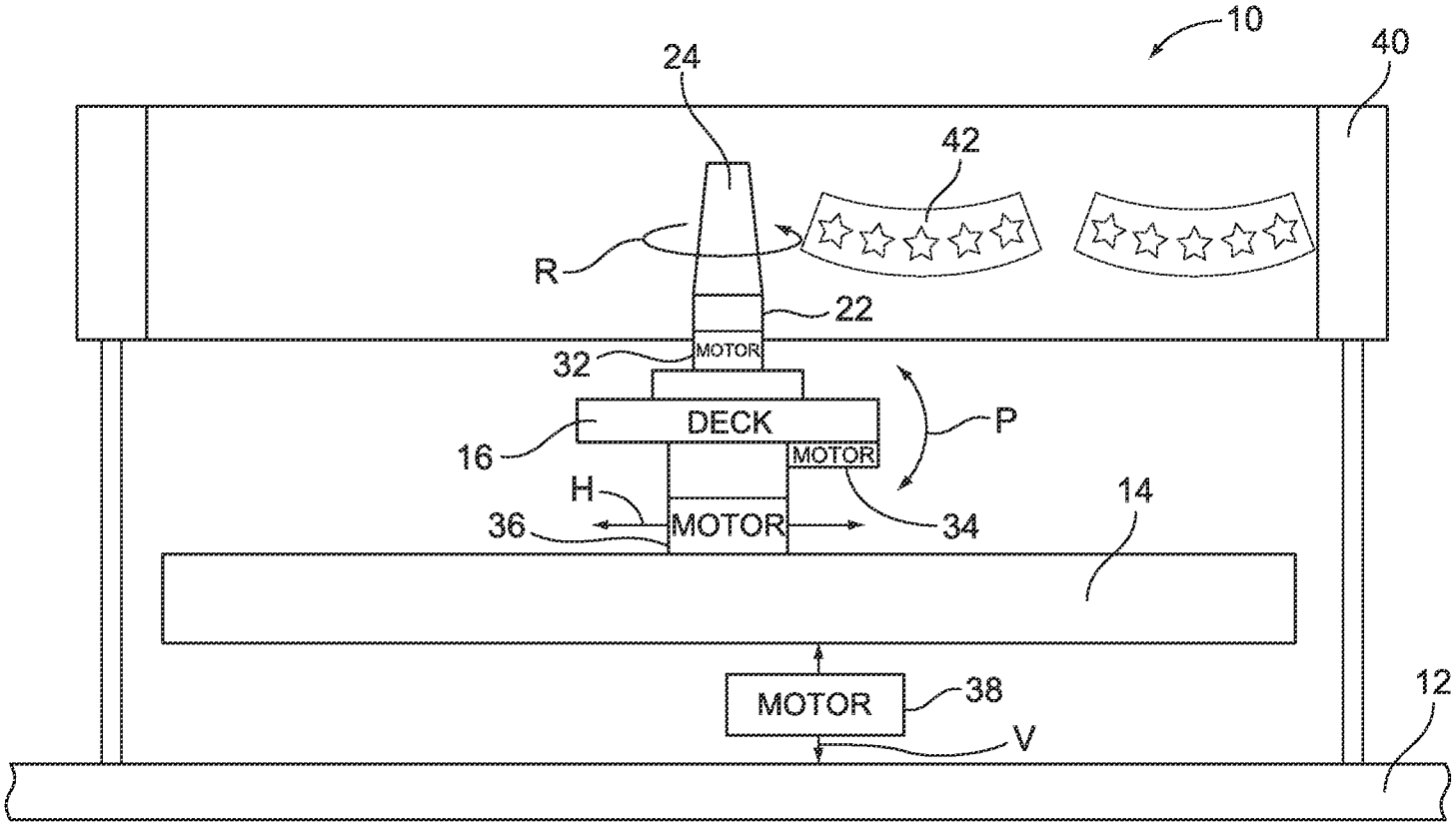
FIG. 1 is a general schematic showing the primary components of the decorating machine according to the illustrated embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 is a schematic view of a decorating machine 10 that shows the primary working components of the decorating machine 10 in accordance with one embodiment of the present invention. The decorating machine 10 includes a base 12 and a track structure 14 above the base 12. A deck 16, which can pivot, is located above the track structure 14. The deck 16 includes a rotating mount 22 on which a product 24 is mounted. In a preferred embodiment, the product 24 is held on the rotating mount 22 through a vacuum-type of arrangement. Additionally, a roll of film 40 includes artwork 42 that will be placed on the frustoconical surface of the product 24, as described below.

The decorating machine 10 includes a plurality of motors that permit the product 24 to move in a pendulum-like manner as will be described in more detail below with respect to FIGS. 3-4. A first motor 32 provides rotational movement to the rotating mount 22, and thus rotational movement to the product 24 in accordance with the arrow R. A second motor 34 causes the deck 16 to pivot in a direction associated with the arrow P. A third motor 36 causes the deck 16 to move in a horizontal direction generally associated with the arrow H. A fourth motor 38 causes the track structure 14 and, thus, the deck 16 to move in a vertical direction generally associated with the arrow V. The location of the motors 32, 34, 36, 38 in FIG. 1 are only for illustration purposes. The actual locations of the motors 32, 34, 36, 38 within the decorating machine 10 can vary. And while this general description of the decorating machine 10 in FIG. 1 has indicated that the working components include motors, other types of movement-causing devices, such as fluid-power rotary machines or other pneumatic machines can be used as well. It should be understood that the decorating machine 10 includes a controller and a memory device for performing the calculations described below with reference to FIG. 5 and for controlling the movements of the motors 32, 34, 36, 38.

Figure 2:
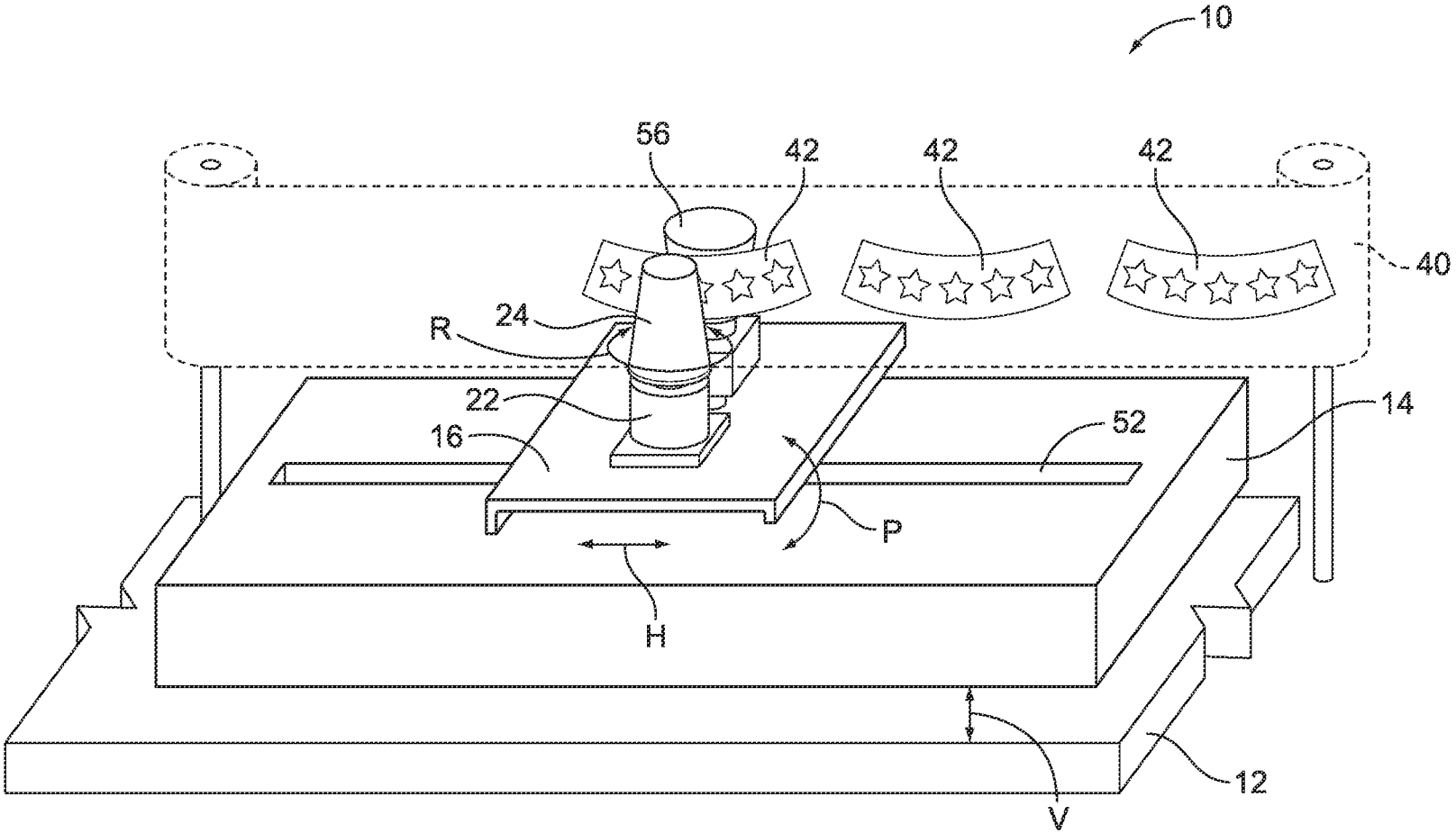
FIG. 2 is a perspective view of the components of the decorating machine, including the location of the artwork associated with the decorating machine.

FIG. 2 is a perspective view of the decorating machine 10. The deck 16 is movably mounted to a track 52 located within the track structure 14 that confines its movement to the horizontal direction H, which is also the direction that the film 40 extends. The track 52 may be comprised of a variety of structures to effectuate this linear movement, such as chains or ball-screw devices. In one preferred embodiment, the track 52 is comprised of a belt-driven linear motion device.

FIG. 2 also illustrates that the deck 16 includes a roller 56 that is used for the purpose of applying heat and pressure to the film 40 such that the artwork 42 attaches to the product 24. The film 40 is located between (and is essentially sandwiched by) the roller 56 and the product 24. The roller 56 is typically a follower roller in that it follows the rotational movement R of the product 24. In other words, in a preferred embodiment, the roller 56 has no drive mechanism, like a motor, to provide it with independent rotational movement. The roller 56 also has a frustoconical shape that generally corresponds to the frustoconical surface of the product 24. In other words, if the roller 56 were to be placed upside-down, it would have the same taper angle as the frustoconical surface of the product 24.

The roller 56 can be adjusted between an engaged position (shown in FIG. 2) in which it is providing pressure and heat to the film 40 and a disengaged position in which it is located away from the film 40 and the product 24. The movement of the roller 56 between the engaged position and a disengaged position can be accomplished through a variety of manual or automated mechanisms, including a motor. The roller 56, which typically includes a silicone rubber outer surface, can be heated through various heating mechanisms such as an infrared heater or an internal heating element. The roller 56 applies several hundred pounds per square (e.g. 400 psi) and has an external surface temperature that is several hundred degrees Fahrenheit (e.g., 200° F. to 360° F.). The actual pressure and temperature is a function of the materials and thicknesses of the film 40 and the artwork 42, the material of the product 24, and the rotational speed at which the product 24 moves relative to the artwork 42.

Figure 4:
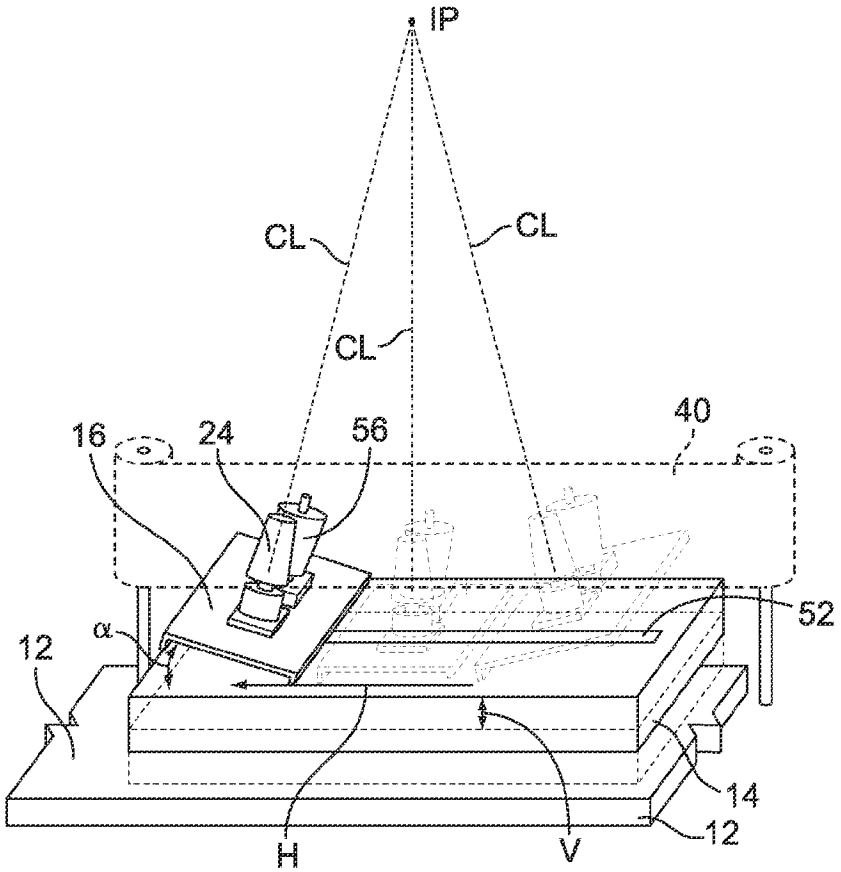
FIGS. 3 and 4 illustrate the pendulum-like motion associated with the machine.
Figure 3:
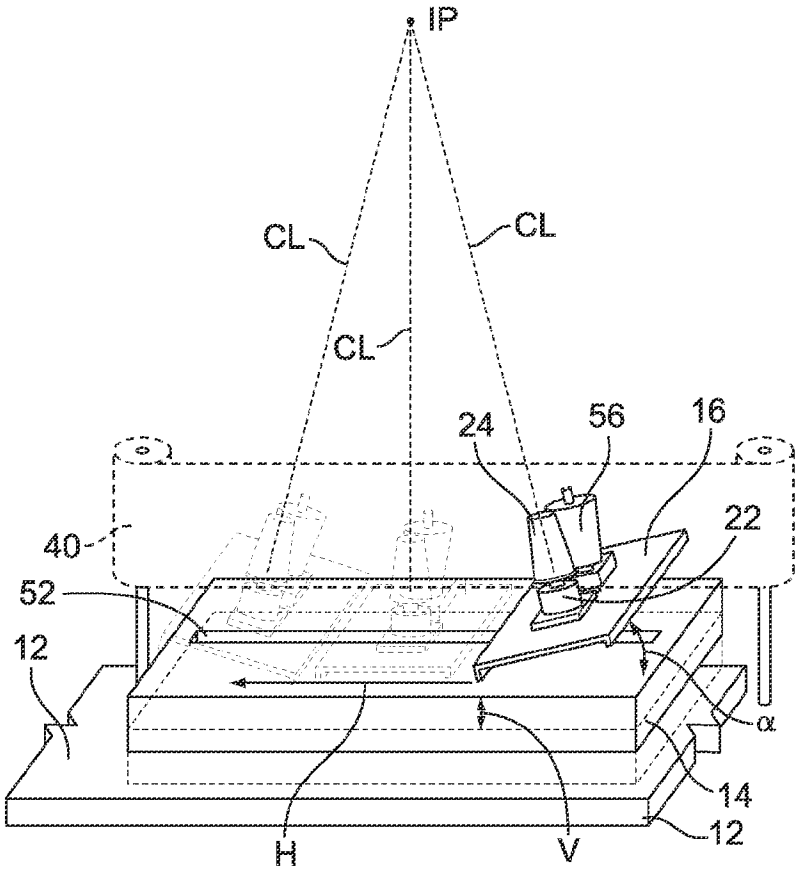

FIGS. 3-4 illustrate the pendulum-like movement that the product 24 undergoes due to the pivotal movement P, the horizontal movement H, and the vertical movement V described above with respect to FIGS. 1 and 2. The product 24 has a centerline CL around which its frustoconical exterior surface is symmetrically arranged. In FIG. 3, the deck 16 is at the right position of the decorating machine 10 and is at a certain pitch angle "α". As discussed in more detail below in FIG. 5, the absolute location of this right position and the pitch angle "α" is dictated by the size and frustoconical shape of the product 24. As the deck 16 moves along the track 52 toward the left position (FIG. 4), the pitch angle "α" is reduced to a point where it eventually reaches zero in the middle dashed-line image of the deck 16. As the deck 16 continues moving toward the left position, the pitch angle "α" begins to increase until it reaches the same pitch angle "α", (i.e., the pitch angle "α" is the same in FIG. 3 and FIG. 4). In other words, when considering the pitch angle "α" of the deck 16, the deck 16 has undergone symmetrical angular movement (i.e., its pivotal movement P) while the deck 16 has undergone the horizontal movement H from the right position (FIG. 3) to the left position (FIG. 4).

Additionally, the deck 16 also undergoes a reciprocating vertical movement due to the vertical movement V of the track structure 14 (and thus the track 52). As can be seen by the dashed lines, the track structure 14 moves downwardly (towards the base 12) as the horizontal movement H progresses from the right position (FIG. 3) until the deck 16 is located at the middle dashed-line image. Then, the track structure 14 moves upwardly (away from the base 12) as the horizontal movement H continues until the deck 16 is located in the left position in FIG. 4.

Due to the combination of the (i) the pivotable movement P of the deck 16, (ii) the vertical movement V of the track structure 14, and (iii) the horizontal movement H of the deck 16 along the track 52, the product 24 will undergo a pendulum-like movement along a curved path, as shown in FIGS. 3-4. In essence, the centerline CL of the product 24, when projected upwardly from the product 24, extends through an imaginary pivot point IP at all instances when moving from the right position in FIG. 3 to the left position in FIG. 4. The pendulum-like movement of the product 24 along its curved (or arced) path substantially corresponds to the curved shape of the artwork 42, which remains stationary during the process.

Of course, it will be understood that this pendulum-like movement will never be perfect due to the manufacturing tolerances of the parts and the various types of movements associated with motors. As such, the present invention contemplates the use of the decorating machine 10 in instances when the movement of the product 24 is not perfectly like a pendulum, when only a portion of the product's movement with a stroke is in a pendulum-like fashion, and when the product's movement is purposefully designed to be along a curved path, but not like a pendulum.

While the product 24 undergoes the pendulum-like movement, the product 24 also rotates via the rotating mount 22 located on the deck 16. Accordingly, the frustoconical surface of the product 24 is, in essence, rolled across the artwork 42, which remains substantially stationary during the rotational movement and pendulum-like movement of the product 24. In one embodiment described below, the rotational movement of the product 24 will be at a variable rate depending on the product's location relative to the artwork 42. The heat and pressure applied by the roller 56 causes the artwork 42 to become attached to the frustoconical surface of the product 24. In another embodiment described below, the rotational movement of the product 24 will be constant such that the pressure and heat applied to the artwork and the product 24 is fairly consistent around the circumference of the product 24.

The description related to FIGS. 3-4 illustrates one "stroke" of the overall cycle. Once the product 24 has received the necessary artwork 42 in this one stroke, which has finished in the state shown in FIG. 4, a second stroke can begin. As such, the decorating machine 10 operates in a manner in which a first product 24 receives the artwork 42 during the first stroke (i.e., during the movement from FIG. 3 to FIG. 4). Then, while the deck 16 is in the left position shown in FIG. 4, the finished product 24 is removed from the rotating mount 22 and an unfinished product 24 is placed on the rotating mount 22. Additionally, the roller 56 is moved to its disengaged position and the film 40 is advanced to a location where an additional piece of artwork 42 is located at the correct position for attachment to the unfinished product 24 that is to be placed (or has been placed) on the rotating mount 22. The roller 56 is then moved to its engaged position and the pendulum-like movement and rotational movement of the unfinished product 24 begins in a left-to-right fashion. Once it has moved to the right position (shown in FIG. 3), a full cycle consisting of two "strokes" has been completed, resulting in two products 24 receiving artwork 42.

The present invention contemplates the use of manual or automated removal processes for the product 24. In an automated removal process, at least one robotic arm (and preferably two robotic arms) grasps the finished product 24 that has received the artwork 42 to remove it from the deck 16 and places an unfinished product 24 on the rotating mount 22 of the deck 16. Even more preferably, there are four robotic arms, a set of two located on the right and a set of two located on the left. Each set is responsible for the removal of finished product 24 from the deck 16 and the placement of unfinished product on the rotating mount 22 on the deck 16.

Figure 5:
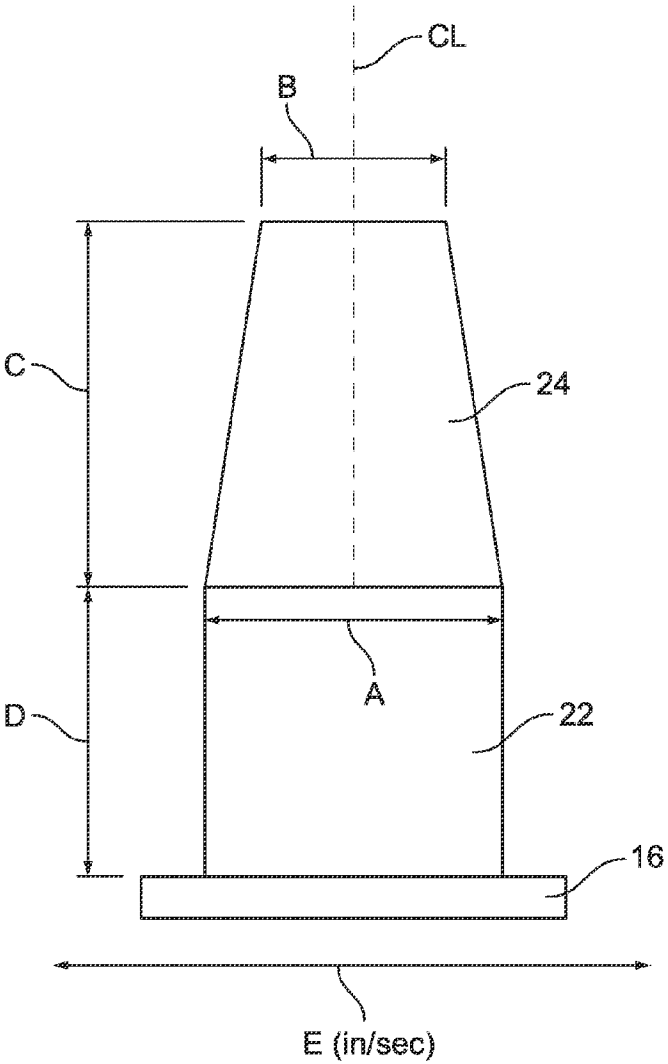
FIG. 5 illustrates the variables of the to-be-decorated product that are entered into the machine's user interface for permitting an automatic calculation of the specific type of pendulum-like motion that is needed for that product.

FIG. 5 illustrates the variables that are input to the decorating machine 10 so that the exact pendulum-like movement and rotational movement can be calculated by an system controller for the specific shape of the product 24. The decorating machine 10 typically has an operator interface (e.g., keyboard, touchscreen, etc) to input this data and also a display to provide the operator with the status and current operating conditions of the decorating machine 10. Regarding the inputs, the major diameter "A", minor diameter "B", and length "L" of the product 24 are required. Even if the product 24 is only to have artwork 42 located along a portion of its length, the major diameter "A" and minor diameter "B" can still be used because the heat and pressure will still be applied from the roller 56 over the entire length "L," even though the artwork 42 covers only a portion of the length "L." The distance "D" for the deck 16 to the major diameter "A" (i.e., the height of the rotating member 22) is also required. It should be noted that calculations of the movements of the deck 16 also require the distance of the upper surface of the deck 16 to the underlying track 52, which is described below, but since this is a constant, the user is only required to input the distance "D". The rotating member 22 is typically a tool that is specifically developed for each type of product 24, such that the machine 10 accommodates a variety of rotating members 22 for the variety of products 24 that can be placed in the machine 10. Finally, the horizontal speed "E" associated with the horizontal movement H along the track 52 is also required. It should be noted that, to maintain a consistent horizontal speed "E" while the artwork 42 is being attached, it is necessary for the deck to have a pre-start position that is further from the center line of the decorating machine 10 so as to permit acceleration from 0.0 inches/second to "E" inches/second prior to the start of the artwork 42 being attached.

In one preferred embodiment, the horizontal location of the deck 16 within the track 52 dictates the other variables. In other words, once the information set forth in FIG. 5 is inputted into the decorating machine 10, the rotational speed of the rotating mount 22, the vertical location track structure 12, and the pitch angle of the deck 16 are calculated by the controller as a function of the horizontal location of the deck 16. Therefore, as the deck 16 advances horizontally via the constant horizontal movement along the track (at horizontal speed "E"), each new horizontal-direction increment results in (i) a certain rotational speed of the rotating mount 22, (ii) a certain vertical location of the track structure 14 (and thus the deck 16), and (iii) a certain pitch angle at which the deck 16 must be oriented. Preferably, there are feedback loops related to these different types of movement to ensure the variables are properly achieved for each increment of movement in the horizontal direction. Of course, other systems could be derived that would permit these variables to be evaluated in different way such that they are function of another variable, as opposed to the horizontal location that has been described.

In another preferred embodiment, the rotational speed R of the rotating mount 22 is constant and the horizontal speed changes. In this situation, the product's inputted information in FIG. 5 would exclude the horizontal speed "E" and would include a contact-surface rotational speed (i.e. the contact between the roller 56 around the circumference of the product 24). Thus, different locations of the circumference around the frustoconical surface of the product 24 would encounter the roller 56 for substantially the same amount of time (i.e., receiving substantially the same amount of heat and pressure). In use, there may be various iterations for applying the artwork to a specific product 24 at different speeds to determine which circumferential speed works the best for the geometry of that particular product 24. Then, the desired circumferential speed would be entered as an input by the operator, like the other variables in FIG. 5.

In this embodiment, the horizontal location of the deck 16 within the track 52 dictates the other variables as in the previous embodiment. In other words, once the information in FIG. 5 is inputted into the decorating machine 10 (with the circumferential speed substituted for the horizontal speed "E"), the horizontal speed of the deck 16 on the track, the vertical location track structure 12, and the pitch angle of the deck 16 are all a function of the horizontal position H of the deck 16 (as in the previous embodiment). Therefore, as the deck 16 advances horizontally via the variable horizontal movement along the track, each new horizontal-direction increment results in (i) a certain horizontal speed of the deck 16, (ii) a certain vertical location of the track structure 14 (and thus the deck 16), and (iii) a certain pitch angle at which the deck 16 must be oriented. But, unlike the previous embodiment, the contact-surface rotational speed remains constant. As discussed above, the system preferably includes feedback loops related to these different types of movement to ensure the variables are properly achieved for each increment of angular movement.

With reference to FIGS. 3-5, the following example illustrates the calculation of variables when the contact-surface rotational speed remains constant (as opposed to the horizontal speed "E"). User Input Values: "A"=3.662 in; "B"=2.642 in; "C"=5.0 in; "D"=6.0 in; Rotational Speed at the Major Diameter=2.00 in/sec.

| | |
|---|---|
| IMAGINARY PIVOT POINT OF PRODUCT ("IPPP") = | [C/(A/2 − B/2)] × A/2 = 17.951 in |
| IMAGINARY PIVOT POINT OF ACTUAL SYSTEM ("IP" - See FIGS. 3-4) = | IPPP + D + MECHANICAL OFFSET OF DECK 16 ABOVE TRACK 52 (here 2.35 in) = 26.301 in |
| "TAPER ANGLE" OF PRODUCT 24 (+/− FROM CENTER LINE) | (A/2 − B/2)/C = 0.102 radians |
| "RADIAN ARC" (ANGLE or ARC NEEDED TO ROLL PRODUCT 24 AGAINST ARTWORK, +/− FROM CENTERLINE of MOVEMENT) = | π × TAPER ANGLE = 0.320 radians |
| SINE OF RADIAN ARC = | = 0.315 |
| X-AXIS TRAVEL (+/− FROM CENTER LINE OF MOVEMENT) | = IP × SINE OF RADIAN ARC = 8.284 in |
| TOTAL X-AXIS TRAVEL (START-UP AND STOP MOVEMENT OF 0.5 in INCLUDED) = | = X-AXIS TRAVEL + 0.5 in = 8.784 in |
| CHANGE IN PITCH ANGLE "α" OF DECK 16 PER INCH OF X-TRAVEL | = RADIAN ARC/X-AXIS TRAVEL = 0.0386 radians/in |

In this set up, it is assumed that there is 2.35 inches from the top surface of the deck 16 to the track 52 below the top surface. In essence, the 2.35 inches is added to "D" to obtain the true length of the "pendulum" as the deck 16 simulates the pendulum-like movement. Further, it is assumed that there is a need for 0.5 inch of additional horizontal movement at the start and the finish of the stroke since the machine 10 must be given some time to start (i.e., accelerate) from 0 in/second and to stop (i.e., decelerate) to reach 0 inch/second. As indicated above, the various parameters for the system will change as a function of the horizontal position. For the product in the example above, the following values are calculated by the controller of the system when the horizontal position of the deck 16 is at −7.0 inches (i.e., the deck 16 has traveled 15.784 in of horizontal movement out of the total 17.568 in of total horizontal movement from right to left).

| | |
|---|---|
| PITCH ANGLE "α" OF DECK 16 = | X AXIS HORIZONTAL DISPLACEMENT × CHANGE IN PITCH ANGLE "α" PER INCH = −0.271 radians (15.527 degrees) |
| COSINE of PITCH ANGLE "α" = | 0.9635 |
| VERTICAL DISPLACEMENT (V) (MEASURED FROM ZERO POINT WHEN DECK 16 IS AT LOWERMOST POINT) = | IP − (IP × COSINE OF PITCH ANGLE "α") = 0.960 in |
| ROTARY SURFACE SPEED = | 2.0 in/sec (AT MAJOR DIAMETER) |
| HORIZONTAL SPEED OF DECK 16 | = ROTARY SURFACE SPEED × COSINE OF PITCH ANGLE) = 1.927 in/sec |

Of course, the values would constantly change based on the incremental horizontal movement to new positions along the X-axis. When the product's information is inputted by the operator (e.g., FIG. 5), the controller may calculate these values in a set up mode for each increment of horizontal movement and store them in a look-up table in the memory device for use during operation.

While the present invention has been described with artwork 42 that is fed on a continuous length of film 40, it should be understood that any type of artwork 42 placement between the product 24 and the roller 56 will work a well. Thus, reciprocating sheets of artwork 42 that move through the attachment zone defined between the product 24 and the roller 56 will achieve a result consistent with the illustrated embodiment. Additionally, the film-feeding process for the artwork 42 can be physically and/or operationally separated from the operation of the decoration machine 10. For example, the decorating machine 10 may simply include an optical reader to determine that the artwork 42 has been fed into the appropriate location in the attachment zone between the product 24 and the roller 56. In this case, while such a film-feeding process may not technically be a component of the decoration machine 10, the present invention still considers such a film-artwork arrangement to be a component of the inventive decoration machine 10. In each of these cases, the film 40 is advanced forward and indexed to a certain location within the machine 10 such that its placement at the correct location is preferably sensed by an optical reader, which helps to determine when that the machine 10 can begin the operation of applying the artwork 42 to the newly advanced artwork on the film 40.

While the illustrated embodiment includes distinct artwork 42 that is applied to only part of the frustoconical surface, the term "artwork" should be understood to include solid colored films as well that are placed over the entire frustoconical surface. Thus, the film 40 could be made of one solid color or include a solid coating. Films can be made of a variety of materials, but are most typically polymeric.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A decorating machine for applying artwork to a product having a central axis and a frustoconical surface around the central axis, comprising:

a film that includes the artwork, the film extending in a first direction;

a deck having a rotating mount on which the product is mounted, the deck being pivotable to adjust the pitch angle of the deck;

a track structure including a track extending in the first direction, the deck moving along the track in the first direction, the track structure further being movable in a second direction generally perpendicular to the first direction;

a roller for forcing the artwork against the frustoconical surface of the product, the roller providing heat and pressure to the film such that the artwork becomes attached to the frustoconical surface of the product;

wherein the combination of (i) the pivotable movement of the deck, (ii) the movement of the track structure in the second direction, and (iii) the movement of the deck along the track in the first direction, causes the product to undergo a pendulum-like movement while the product is rotating around the central axis due to the rotation of the rotating mount.

2. The decorating machine of claim 1, wherein the artwork remains substantially stationary while the product undergoes the pendulum-like movement.

3. The decorating machine of claim 1, wherein the artwork has a curved shape for fitting around the frustoconical surface and the pendulum-like movement causes the product to move in a manner that substantially corresponds to the curved shape of the artwork.

4. The decorating machine of claim 1, further including a plurality of motors for providing (i) the pivotable movement of the deck, (ii) the movement of the track structure in the second direction, and (iii) the movement of the deck along the track in the first direction.

5. The decorating machine of claim 1, wherein the roller has a frustoconical shape that substantially corresponds to the frustoconical surface of the product.

6. The decorating machine of claim 5, wherein the roller is moveable from a disengaged position to an engaged position at which the roller engages the film such that the pressure and heat can be applied to the artwork as the artwork contacts the product, the roller remaining in the engaged position during the pendulum-like movement of the product.

7. The decorating machine of claim 6, wherein the roller includes an internal heating system to provide the heat to the film.

8. The decorating machine of claim 1, wherein the angular rate of rotation of the rotating mount remains constant and the movement of the deck along the track in the first direction is a variable rate that is function of a location of the deck along the track in the first direction.

9. The decorating machine of claim 1 wherein the (i) the pivotable movement of the deck and (ii) the movement of the track structure in the second direction is each a function of the location of the deck along the track in the first direction.

* * * * *